US010126095B1

(12) United States Patent
Reid

(10) Patent No.: US 10,126,095 B1
(45) Date of Patent: Nov. 13, 2018

(54) BARREL NUT ATTACHED HANDGUARD

(71) Applicant: ZEV Technologies, Inc., Oxnard, CA (US)

(72) Inventor: James E. Reid, Tenino, WA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

(21) Appl. No.: 15/954,918

(22) Filed: Apr. 17, 2018

Related U.S. Application Data

(60) Provisional application No. 62/487,010, filed on Apr. 19, 2017.

(51) Int. Cl.
*F41C 23/16* (2006.01)
*F41A 21/48* (2006.01)
*F41A 3/66* (2006.01)

(52) U.S. Cl.
CPC ..... *F41C 23/16* (2013.01); *F41A 3/66* (2013.01); *F41A 21/48* (2013.01)

(58) Field of Classification Search
CPC .... F41A 21/482; F41A 21/487; F41A 21/484; F41A 21/48; F41C 23/16
USPC ..... 42/75.02, 75.03, 75.1
See application file for complete search history.

(56) References Cited

U.S. PATENT DOCUMENTS 8,448,367 B2 5/2013 Samson et al.
8,607,490 B1 12/2013 Zinsner
8,863,426 B1 10/2014 Zinsner
9,003,686 B2 4/2015 Brown
9,157,697 B2 10/2015 Leclair
9,335,117 B2 * 5/2016 Miller ..... F16B 39/04
9,528,793 B1 * 12/2016 Oglesby ..... F41C 23/16
9,857,138 B2 1/2018 Geissele
9,909,836 B2 3/2018 Galletta, II
9,939,228 B2 4/2018 Cheng et al.
2011/0126443 A1 6/2011 Sirois
2012/0042557 A1 2/2012 Gomez et al.
2012/0180358 A1 7/2012 Samson et al.
2014/0026459 A1 1/2014 Yan et al.
2015/0316347 A1 * 11/2015 Shea ..... F41C 23/16 42/75.02
2016/0054096 A1 2/2016 Dzwill
(Continued)

*Primary Examiner* — J. Woodrow Eldred
(74) *Attorney, Agent, or Firm* — Wood Herron & Evans LLP

(57) ABSTRACT

A handguard for attachment to a standard AR-pattern firearm upper receiver. A barrel nut has a substantially cylindrical outer surface with an annular groove. A handguard sleeve has an end opening configured to slide over the outer surface of the barrel nut, a channel with a bottom guide surface, and a substantially transverse cross bore positioned to at least partially intersect the end opening to align with the annular groove when the handguard sleeve is positioned on the barrel nut. A pair of wedge members are sized to be received in the channel and connected by at least one wedge fastener configured to adjustably move the wedge members together. When the barrel nut is attached to an upper receiver, the handguard sleeve is attached to the upper receiver by sliding the end opening over the barrel nut and inserting a cross bolt fastener in the cross bore and a portion of the annular groove. The wedge members are pulled together by adjusting the wedge fastener, compressing them between the barrel nut and handguard sleeve.

4 Claims, 7 Drawing Sheets

(56) References Cited

U.S. PATENT DOCUMENTS

| | | | |
|---|---|---|---|
| 2017/0097207 | A1 | 4/2017 | Hines |
| 2018/0058807 | A1 | 3/2018 | Cheng et al. |

* cited by examiner

BARREL NUT ATTACHED HANDGUARD

RELATED APPLICATIONS

This application claims priority to U.S. Provisional Patent Application No. 62/487,010, filed Apr. 19, 2017, and incorporates the same herein by reference.

TECHNICAL FIELD

This invention relates to a firearm barrel handguard that attaches to an upper receiver by way of the barrel nut to allow a free-floating barrel.

BACKGROUND

Various structures and methods have been used to attach a handguard to a standard AR-pattern upper receiver, including some that secure the handguard to the barrel nut. However, unless mated with a proprietary design upper receiver, these typically involve the handguard having a longitudinal split that is drawn together to clamp it to the barrel nut. Such clamping requires flexing a portion of the handguard material, which can distort or weaken it.

SUMMARY OF THE INVENTION

The present invention provides a handguard attached to a barrel nut in which a pair of internal wedges are drawn together inside, but independent of, the handguard to secure it in place.

The handguard can be attached to a standard AR-pattern firearm upper receiver. It provides a barrel nut that has a substantially cylindrical outer surface with an annular groove. A handguard sleeve has an end opening configured to slide over the outer surface of the barrel nut, a channel with a bottom guide surface, and a substantially transverse cross bore positioned to at least partially intersect the end opening to align with the annular groove when the handguard sleeve is positioned on the barrel nut. A pair of wedge members are sized to be received in the channel and connected by at least one wedge fastener configured to adjustably move the wedge members together. When the barrel nut is attached to an upper receiver, the handguard sleeve is attached to the upper receiver by sliding the end opening over the barrel nut and inserting a cross bolt fastener in the cross bore and a portion of the annular groove. The wedge members are pulled together by adjusting the wedge fastener, compressing them between the barrel nut and handguard sleeve.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
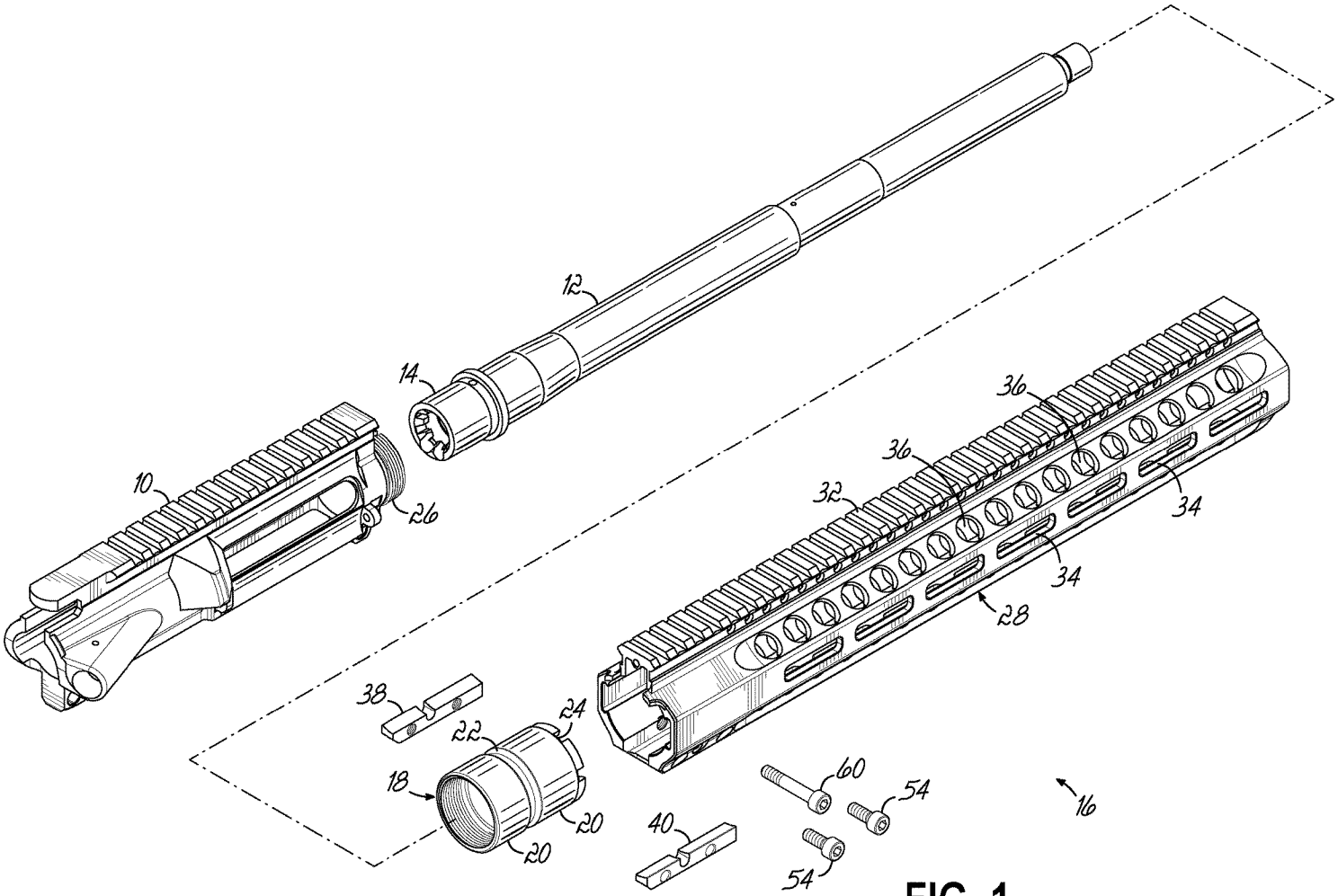
FIG. 1 is an exploded isomeric view of a handguard and barrel nut according to an embodiment of the present invention, along with a standard AR-pattern upper receiver, barrel, and barrel extension.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIG. 1, therein in is shown a standard AR-pattern upper receiver 10, a standard barrel 12 with a barrel extension 14 and a handguard assembly 16 according to an embodiment of the present invention. The barrel 12 and barrel extension 14 are assembled in the ordinary way, and then attached to the upper receiver 10 using a barrel nut 18 configured according to one aspect of this embodiment of the invention.

The barrel nut 18 has a substantially cylindrical outer surface 20 with an annular grove 22 positioned at a region between forward and rear ends. As used herein, "substantially cylindrical" could include a polygonal shape making the surface a series of relatively small flat surfaces that would function as a curved surface. The forward end may include a tool feature, such as notches 24 (in the general configuration of a castle nut), interior or exterior flats, or other known features to accept a tool (not shown) for tightening and/or removing the barrel nut 18. The barrel nut 18 secures the barrel 12 and barrel extension 14 to the upper receiver by threaded engagement with a forward threaded portion 26 of the upper receiver in the ordinary and well-known manner.

Figure 2:
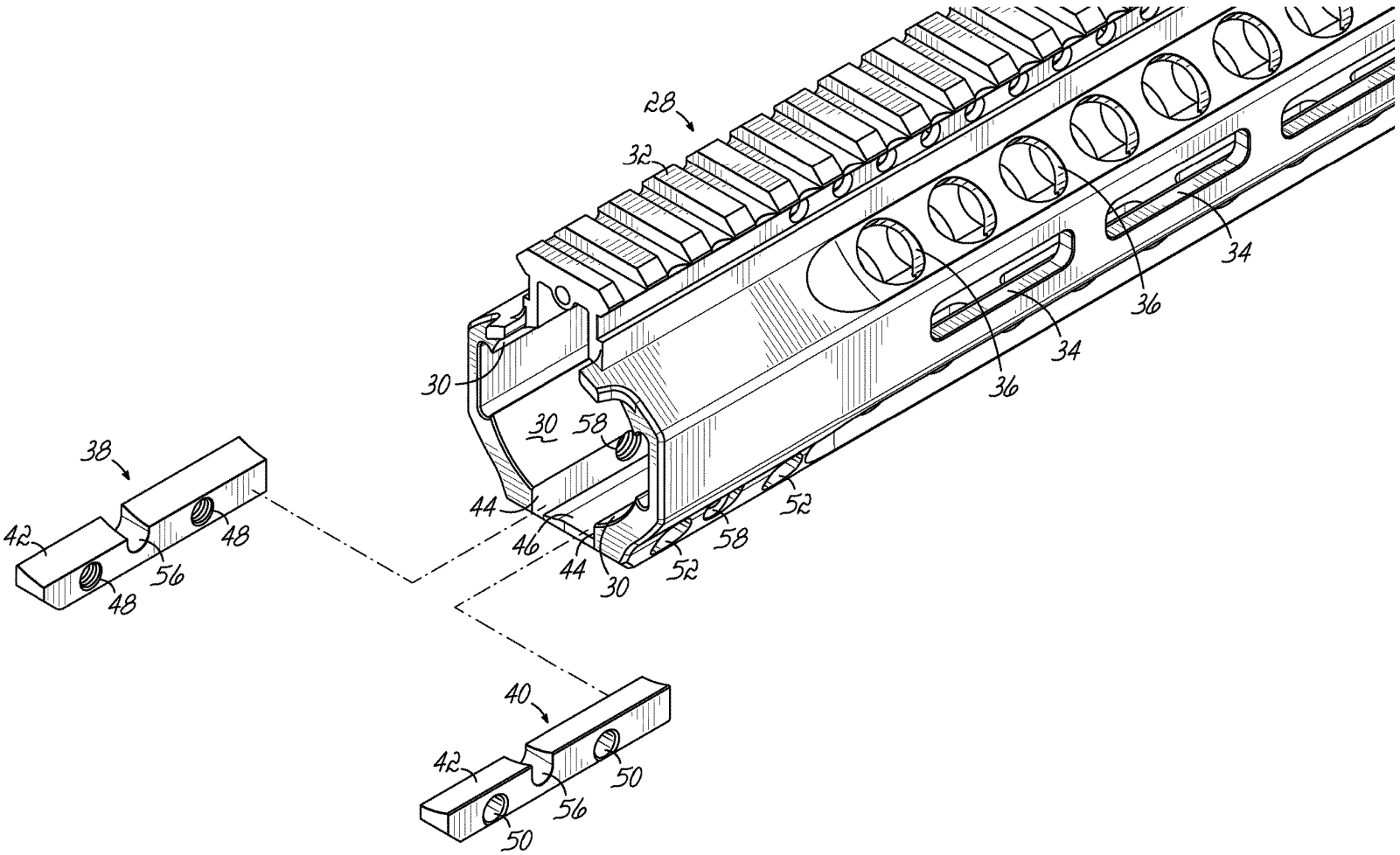
FIG. 2 is a fragmentary isometric exploded view of a rear portion of the handguard, wedge members, and threaded fasteners.

Referring now also to FIG. 2, a handguard sleeve 28 includes interior surfaces 30 at a rear portion thereof configured (such as with a curve) to closely receive the substantially cylindrical surfaces 20 of the barrel nut 18. The handguard sleeve 28 may be made, for example, of extruded or machined metal, such as an aluminum alloy, or of a composite material, such as carbon fiber reinforced epoxy resin. It may optionally include a variety of attachment features, including but not limited to a MIL-STD 1913

(Picatinny) attachment rail 32, other attachment openings 34 (for example, to accept KeyMod™ or M-LOK™ patterned accessories), and/or vent openings 36 to allow heat from the barrel 12 to escape.

Figure 3:
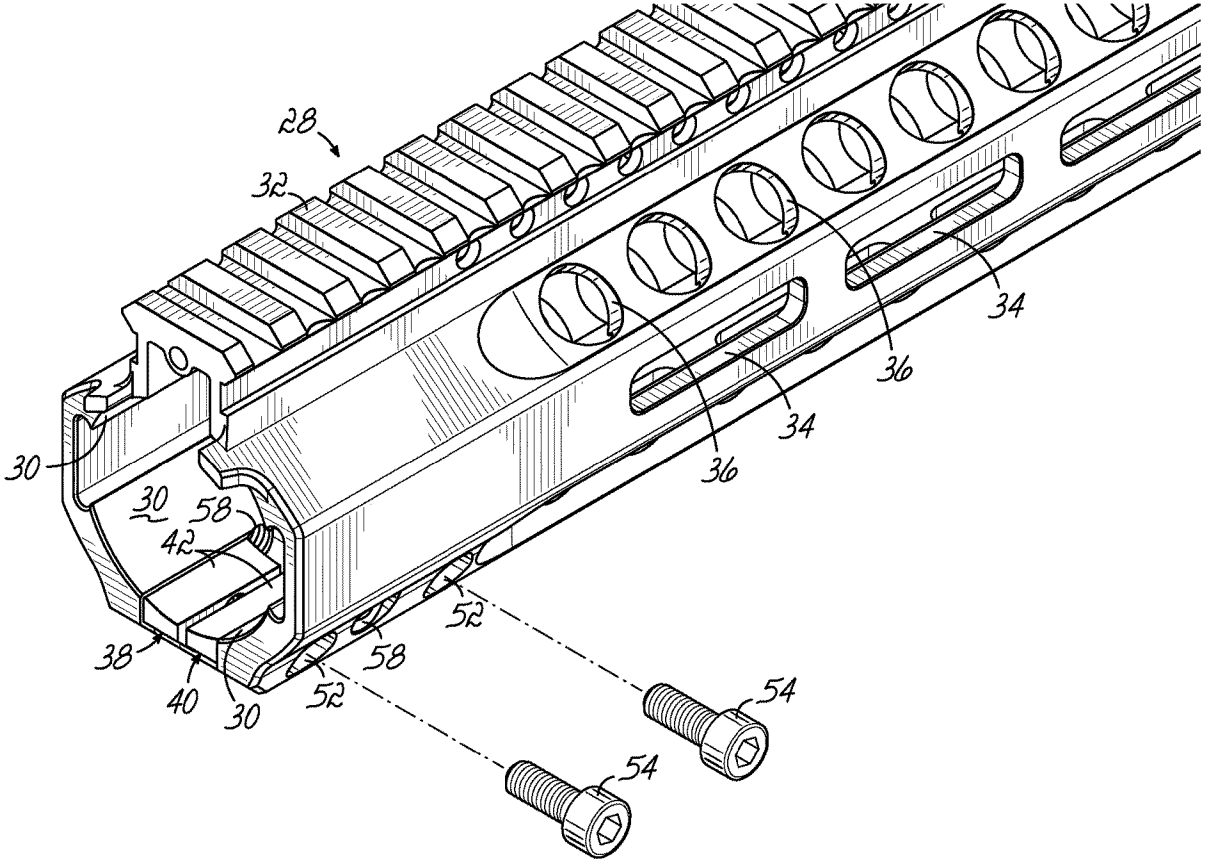
FIG. 3 is a fragmentary isometric partially exploded view thereof with the wedge members in place in the handguard.
Figure 4:
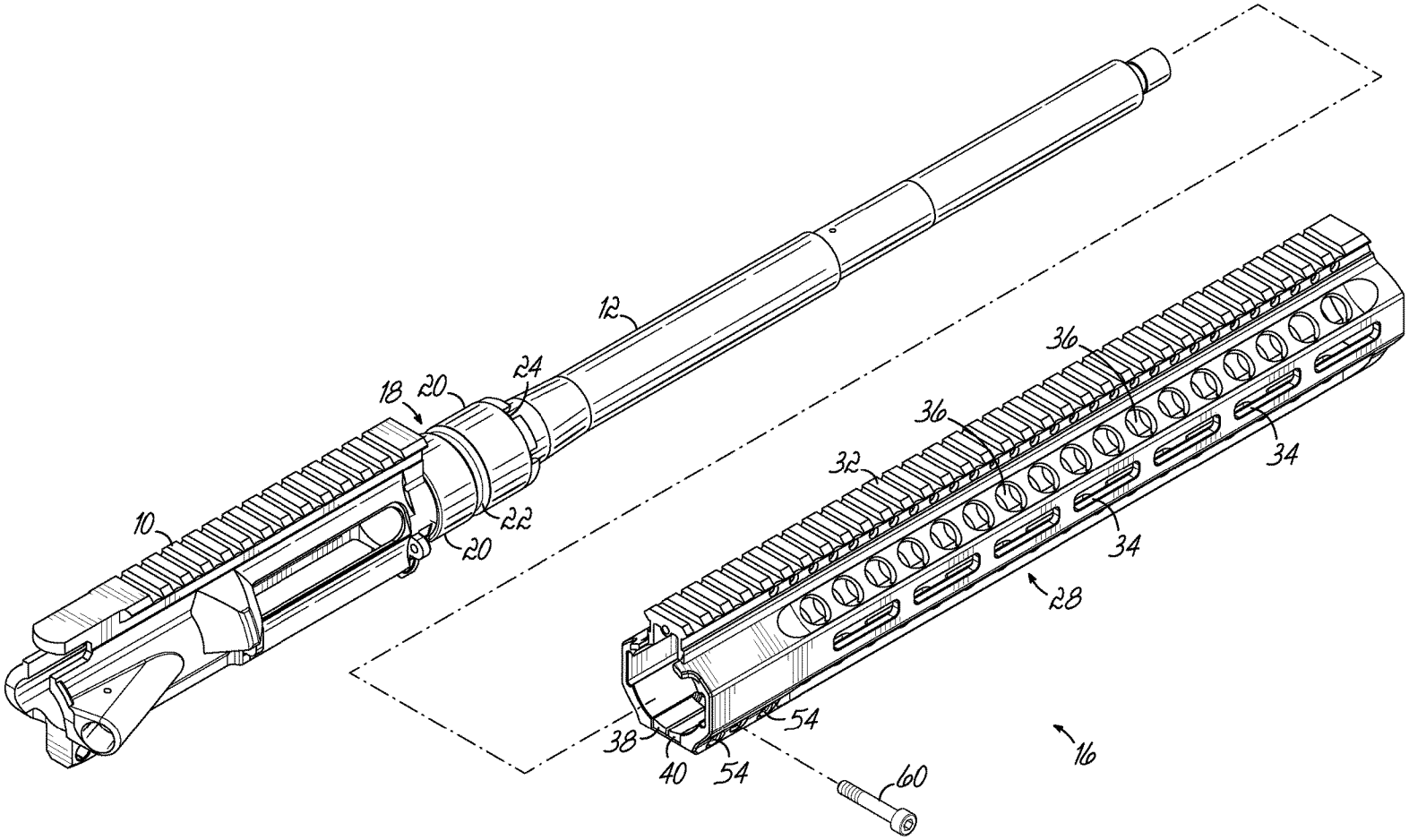
FIG. 4 is an isometric view of the being assembled onto an upper receiver to which a barrel and barrel nut have been installed.

A pair of clamping wedges 38, 40 are provided and each may have a curved surface 42 configured to substantially match the curvature of the substantially cylindrical outer surface 20 of the barrel nut 18 and the curved surfaces 30 on the interior of the handguard sleeve 28. Flat wedge surfaces (not shown) could be used, but may undesirably reduce the area of contact with the barrel nut 18. The handguard sleeve 28 has a channel (shown positioned at the bottom) with side and bottom alignment surfaces 44, 46 configured to receive the clamping wedges 38, 40 in a slightly laterally spaced-apart position, as shown in FIGS. 3 and 4. One of the clamping wedges (in the illustrated embodiment, the left clamping wedge 38) includes one or more spaced-apart threaded openings 48. The opposite clamping wedge (in the illustrated embodiment, the right clamping wedge 40) includes one or more unthreaded bores 50 that are positioned to correspond to the threaded openings 48 in the opposite clamping wedge 38. Likewise, the handguard sleeve 28 may include one or more oversized openings 52 corresponding in alignment with the unthreaded bores 50 and threaded openings 48 when the clamping wedges 38, 40 are positioned within the channel against the alignment surfaces 44, 46. The oversized openings 52 are sized to allow threaded fasteners 54 (including enlarged heads) to pass freely therethrough. The unthreaded bores 50 of the right clamping wedge 40 are sized to allow the threaded portions (but not the enlarged heads) of the threaded fasteners 54 to pass freely there through. The threaded fasteners 54 threadingly engage the threaded openings 48 in the left clamping wedge 38. The enlarged heads of the fasteners 54 in the oversized openings 52 can keep the wedge members 38, 40 in place in the handguard sleeve 28 during further assembly.

As shown in FIG. 4, after the barrel 12 has been secured to the upper receiver 10 with the barrel nut 18, the handguard sleeve 28 with clamping wedges 38, 40 positioned against the alignment surfaces 44, 46 and threaded fasteners 54 in place can be slid over the barrel 12 and barrel nut 18, into contact with the upper receiver 10. As previously described, the curved surfaces 30 on the interior of the handguard sleeve 28 and curved surfaces 42 on the clamping wedges 38, 40 are configured to correspond to and closely fit the substantially cylindrical outer surface 20 of the barrel nut 18.

According to another feature of this embodiment, the wedge members 38, 40 may include laterally corresponding notches or clearance channels 56. When the wedge members 38, 40 are positioned in the handguard sleeve 28, these clearance channels are aligned with a cross bore 58 in the handguard sleeve 28. As shown in FIGS. 2 and 3, the cross bore 58 can be situated, for example, axially between the oversized openings 52. One side (as illustrated, the right side) may include a recess to receive the head of a threaded cross bolt fastener 60 (FIG. 4). The opposite side of the cross bore 58 may be threaded to receive the threads of the cross bolt fastener 60. When inserted, the cross bolt fastener 60 will pass through the clearance channels 56 of the wedge members 38, 40 and partially intersect the substantially cylindrical opening in the rear end of the handguard sleeve 28.

Figure 7:
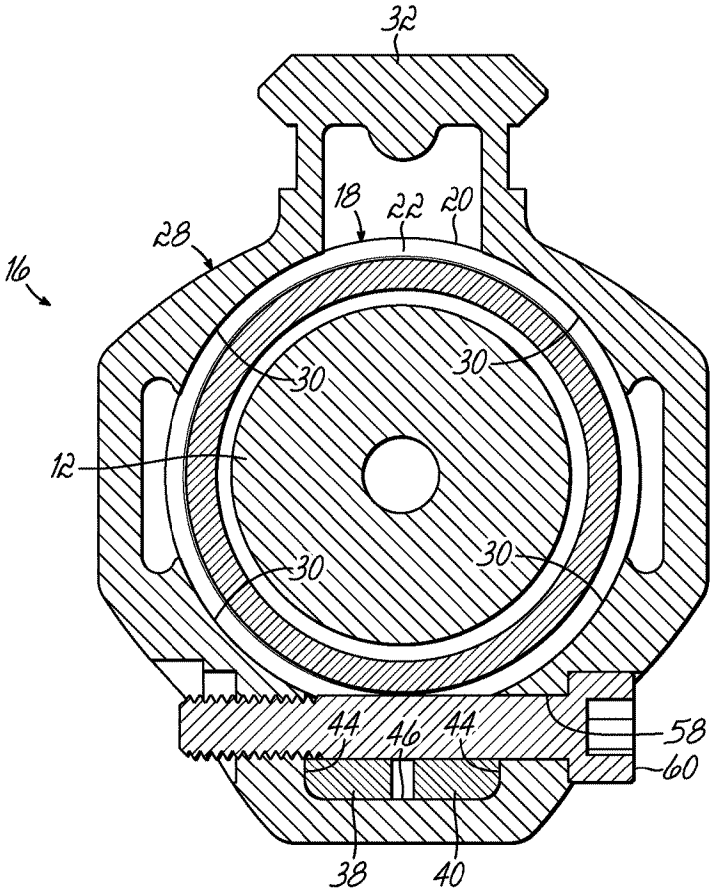
FIG. 7 is a cross sectional view taken substantially along line 7-7 of FIG. 6; and, FIG. 8 is a cross sectional view taken substantially along line 8-8 of FIG. 6.

When the handguard sleeve 28 is slid into place against a forward end of the upper receiver 10, the cross bore 58 and clearance channels 56 of the wedge members 38, 40 will be aligned with the annular groove 22 in the substantially cylindrical outer surface 20 of the barrel nut 18. This allows the cross bolt fastener to be inserted through the cross bore 58, clearance channels 56, and interlock with the annular groove 22, preventing axial displacement of the handguard sleeve 28. This is illustrated in FIG. 7. The cross bolt fastener 60 may be threaded and secured into place without need to compress or flex the handguard sleeve 28. At the bottom of the handguard sleeve 28 is a convenient place to locate the cross bore 58 and to position the cross bolt fastener 60. However, it could be located at the top or side, which would eliminate the need for the clearance channels 56 in the wedge members 38, 40. It could also be located forward or to the rear of the oversized openings 52 and threaded fasteners 54. In such case, a corresponding forward/rear relocation of the annular groove 22 on the barrel nut 18 would be required.

Figure 5:
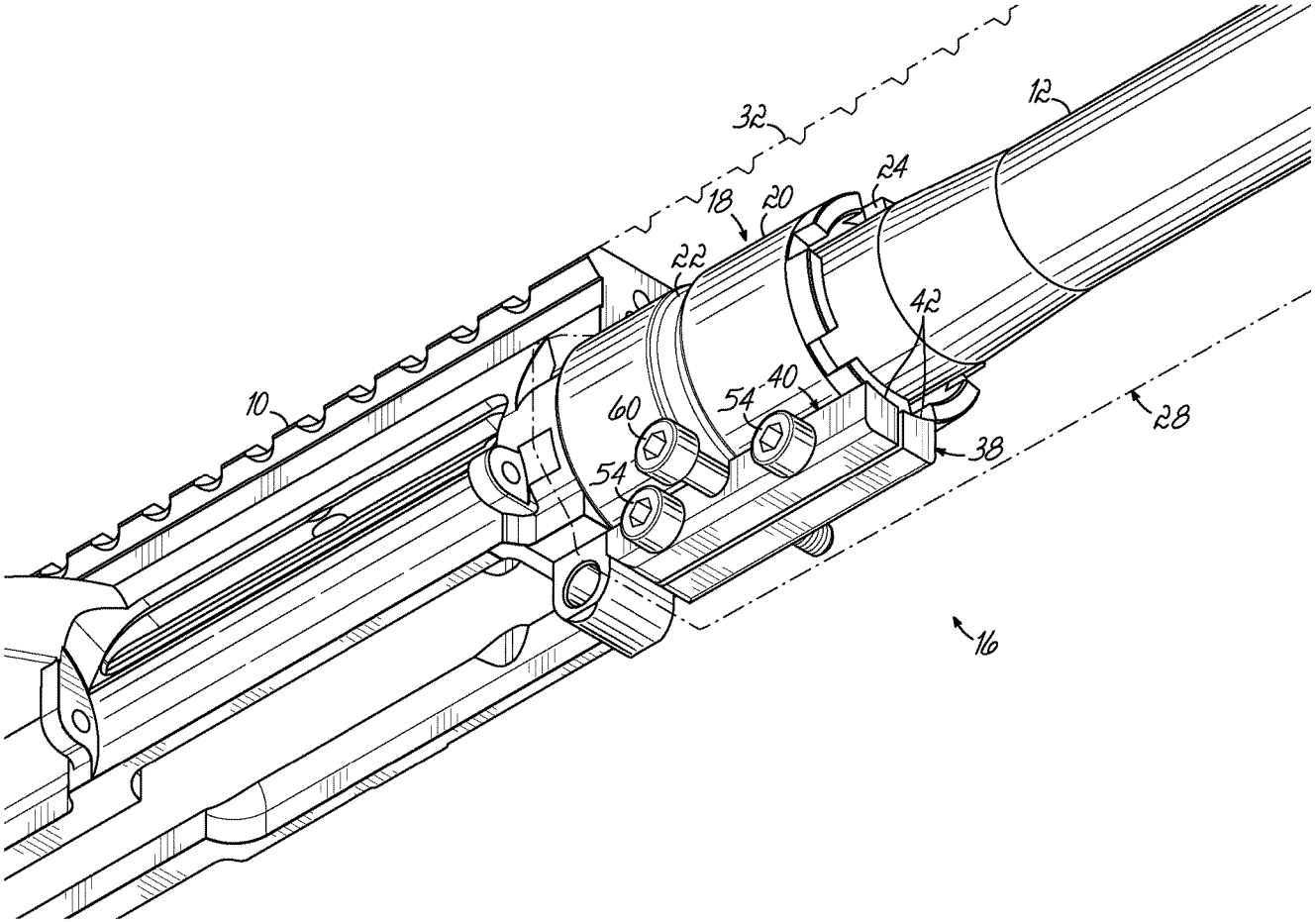
FIG. 5 is an isometric view with the handguard shown in phantom to illustrate placement of the wedge members and threaded fasteners.
Figure 6:
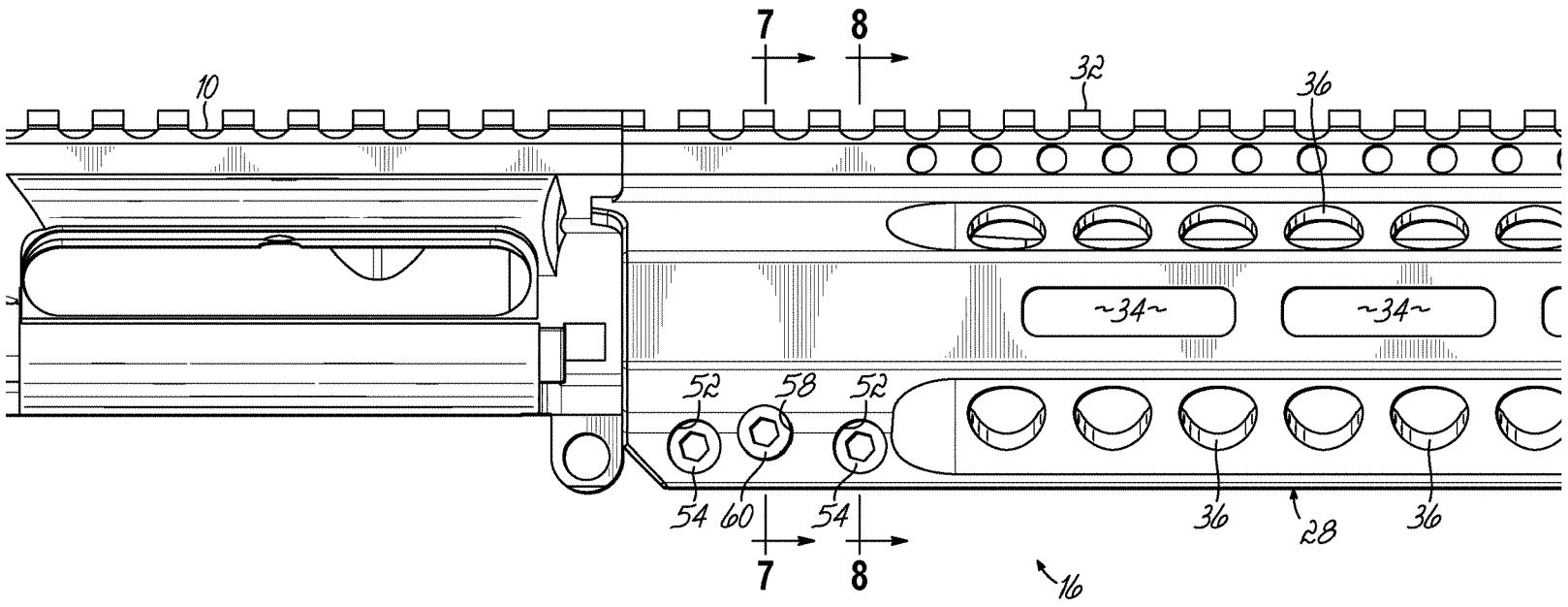
FIG. 6 is fragmentary side elevation view of the handguard assembled to a standard AR-pattern upper receiver.
Figure 8:
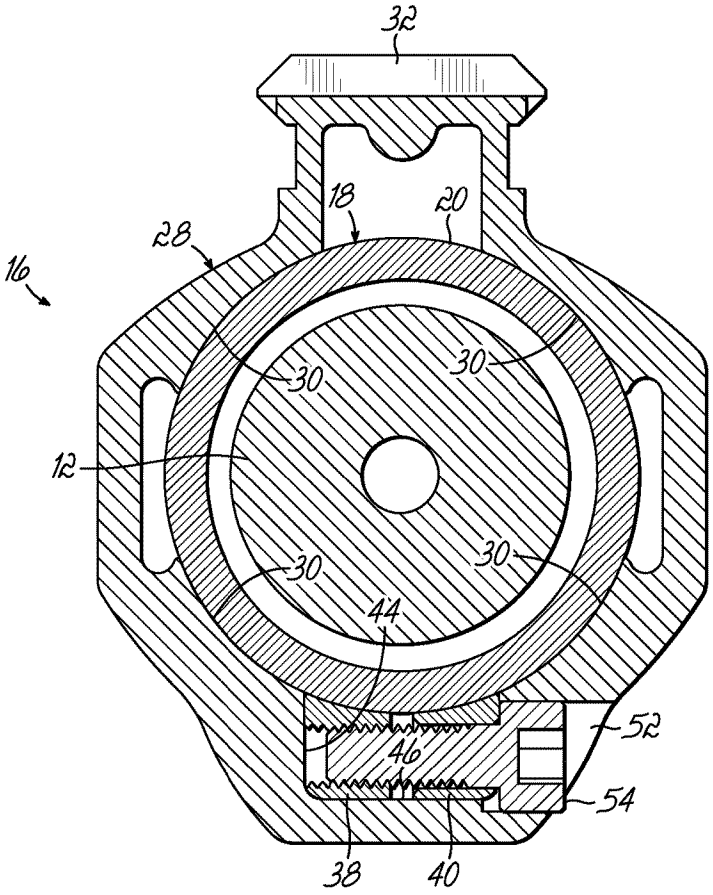

The threaded fasteners 54 then may be tightened to draw the clamping wedges 38, 40 together. Referring now also to FIG. 5, where the position of the handguard sleeve 28 is shown in phantom, moving the clamping members 38, 40 together forces them against and compresses them between the outer surface 20 of the barrel nut 18 and the bottom guide surface 46 of the channel in the handguard sleeve 28, securing it against rotational displacement. This is illustrated in FIG. 8.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A handguard for attachment to a standard AR-pattern firearm upper receiver, comprising:

a barrel nut having a substantially cylindrical outer surface shape with an annular groove positioned between axial ends thereof;

a handguard sleeve having an end opening configured to slide over the outer surface of the barrel nut, a channel with a bottom guide surface, and a substantially transverse cross bore positioned to at least partially intersect the end opening and to align axially with the annular groove when the handguard sleeve is positioned on the barrel nut;

a pair of wedge members sized to be received in the channel and connected by at least one wedge fastener configured to adjustably move the wedge members together; and a cross bolt fastener, wherein, when the barrel nut is attached to an upper receiver, the handguard sleeve is attached to the upper receiver by sliding the end opening over the barrel nut, inserting the cross bolt fastener in the cross bore and a portion of the annular groove, and adjusting the wedge fastener to pull the wedge members together, compressing them between the barrel nut and handguard sleeve.

2. The handguard of claim 1, wherein the wedge members have a curved surface substantially corresponding to the outer surface shape of the barrel nut.

3. The handguard of claim 1, wherein the wedge members include clearance channels positioned to allow passage of the cross bolt fastener.

4. The handguard of claim 1, wherein the barrel nut includes a tool feature.

* * * * *